US005365806A

United States Patent [19]

Paramest

[11] Patent Number: 5,365,806

[45] Date of Patent: Nov. 22, 1994

[54] MECHANICAL BOTTLE AND JAR OPENER

[76] Inventor: Sam S. Paramest, 17407 3rd Ave. SE., Bothell, Wash. 98012

[21] Appl. No.: 96,892

[22] Filed: Jul. 26, 1993

[51] Int. Cl.[5] ..... B67B 7/44

[52] U.S. Cl. ..... 81/3.09; 81/3.29; 81/3.37; 81/3.4

[58] Field of Search ..... 81/3.09, 3.25, 3.37, 81/3.2, 3.29, 3.47, 3.48, 3.4

[56] References Cited

U.S. PATENT DOCUMENTS 760,613 5/1904 Clark et al. ..... 81/3.09 X 4,455,894 6/1984 Roberts ..... 81/3.09

*Primary Examiner*—James G. Smith

[57] ABSTRACT

The device is a three-in-one mechanical remover for bottle caps, bottle corks and jar caps of various sizes. The main frame metal structure has a vertical support post (6) with a pair of connected horizontal bars (8) and (9). The vertical post (6) and the upper T bar (8) are used to support the two different system for the different purposes. The shorter wing of the T bar (8) is installed with a vise system. The system has a vise screw (10) installed on the upper T bar and connects to a movable vise grip housing unit (16). The housing grip is affixed with a toothed rubber grip as an adjustable grip (24*a*). Another matching toothed grip at the foot of the post is installed as a stationary grip (24*b*). The vise grip system can be utilized to open jar caps of the various sizes. Whereas the other longer wing of the upper T bar is installed with a cork screw shaft rod (32) with a wing type cap opener (29) as a handle (28). The shaft rod is connected with a lever bar handle (42) and it's connecting parts of a lever system unit. Whereby the combined cork screw and lever system unit has a working relationship to remove a bottle cork with a leverage means.

3 Claims, 1 Drawing Sheet

MECHANICAL BOTTLE AND JAR OPENER

BACKGROUND OF INVENTION

1. Field of Invention

This invention relates generally to a three-in-one mechanical device for the removal of bottle corks, bottle caps and jar caps of various sizes.

2. Discussion of Prior Art

According to my prior art search, there is no known bottle cap, bottle cork and jar cap remover combined as a single mechanical tool. There have been many combined multipurpose devices invented such as: a combined jar and bottle cap opener, U.S. Pat. No. 3,570,028, R. V. De La Hitte, Mar. 16, 1971, a plastic bag cutter, a can tab remover and bottle cap opener, U.S. Pat No. 4,455,894, Roberts, Jun. 26, 1984, and a versatile bottle cap and jar opener, U.S. Pat. No. 3,751,743, Buck, Aug. 14, 1973. All of the combined openers invented above are not mechanical devices and none of them have a cork screw to remove a bottle cork. There is a known mechanical cork puller U.S. Pat. No. 4,063,473, , Bozzo, Dec. 20, 1977. However, this cork puller has no mechanical adjustable jar opener combined as a part of a multipurpose mechanical tool. There are many people that work in the kitchen regularly and, therefore, need a few effective tools to assist them in saving both time and energy. One problem area is one that people least expect; opening a jar. Since many jars can be opened by hand, people tend to overlook the need of a specific tool. Some jars are sealed quite tightly and people have trouble opening them by hand. Occasionally, some jars are not possible to open with bare hands. Actually we do not have any problems opening tin cans because we already expect that we can not open them by hand; we must have a tool to handle it. In summary, to invent a multipurpose mechanical device that has high leverage power and is compact will be very useful and handy in kitchen work.

OBJECTS AND SUMMARY OF INVENTION

My invention is a three-in-one mechanical opener which is capable of removing bottle caps, pulling bottle corks, and opening jars. Two different sets of moving mechanical parts and systems are invented to share the same main frame support structure. The first set is a cork screw with a wing type bottle cap opener as a cork screw handle. This set of the device is installed and connected with a simple mechanical lever bar system to remove a cork. Another set is a strong vise grip system with an adjustable jar grip to open jar caps of various sizes. The whole unit of these two sets combined has a very simple functional design. It is compact and sturdily built. With the simplicity of the functional parts, the production is less complicated and less expensive. The purpose of this invention is to fulfill the needs in the market place as many non-mechanical combined opener's inventors have attempted to offer to the public at an earlier time. It is also designed for durability and high leverage application power. Both systems of my invention share the same upper T bar and the support post for holding the subjects. That sharing of the main frame structure support is an effective and efficient means of the design. Whereas one side has installed the vise system with a pair of curved rubber grips as an adjustable jar cap opener; the other side has installed a long cork screw shaft with a flat wing bottle cap opener handle and a lever system to remove a bottle cork. The primary objects are:

a. The invention is to provide a single, compact device as a three-in-one mechanical remover of bottle caps, bottle corks and the various sizes of jar caps.

b. Another object is to invent a device which has a compact designed where the main frame structure is utilized to support the different units of the mechanical device. The provision made this device small, compact, and attractive.

c. Another object is to provide a device that is simple to utilize and saves time since it is designed as the mechanical function and as an adjustable device with a very high leverage means.

d. Another object is to save storage space and time by inventing and designing of a single, compact unit with multiple usage capacities. A single tool with many different opportunities for usage should be readily available at all times. Therefore, it tends to be easy to find and utilize to meet daily needs.

e. Further object is it's durability. The device's functional parts are simple and connected freely in the wide open space, unlike some other tools, which may have parts in a very tight and restrictive compartment, for example, Bozzo's device. My invention can be built with a thicker and stronger material. As a result, it would be stronger and last longer.

f. Another object is economy. Since the device can be built with a long expected useful life; it is economical for the user. Besides, it become more economic in that the cost factor of this three-in-one purposes tool remains comparable as one production unit; whereas the opportunity of the usage is multiple.

The foregoing objects, advantages, features and results of this invention, together with various other objects, advantages, features, and results thereof which will be in the light of the following detailed descriptions of the preferred embodiments along with the illustrations in the accompanying drawings.

DETAILED DESCRIPTION OF INVENTION

Figure 1:
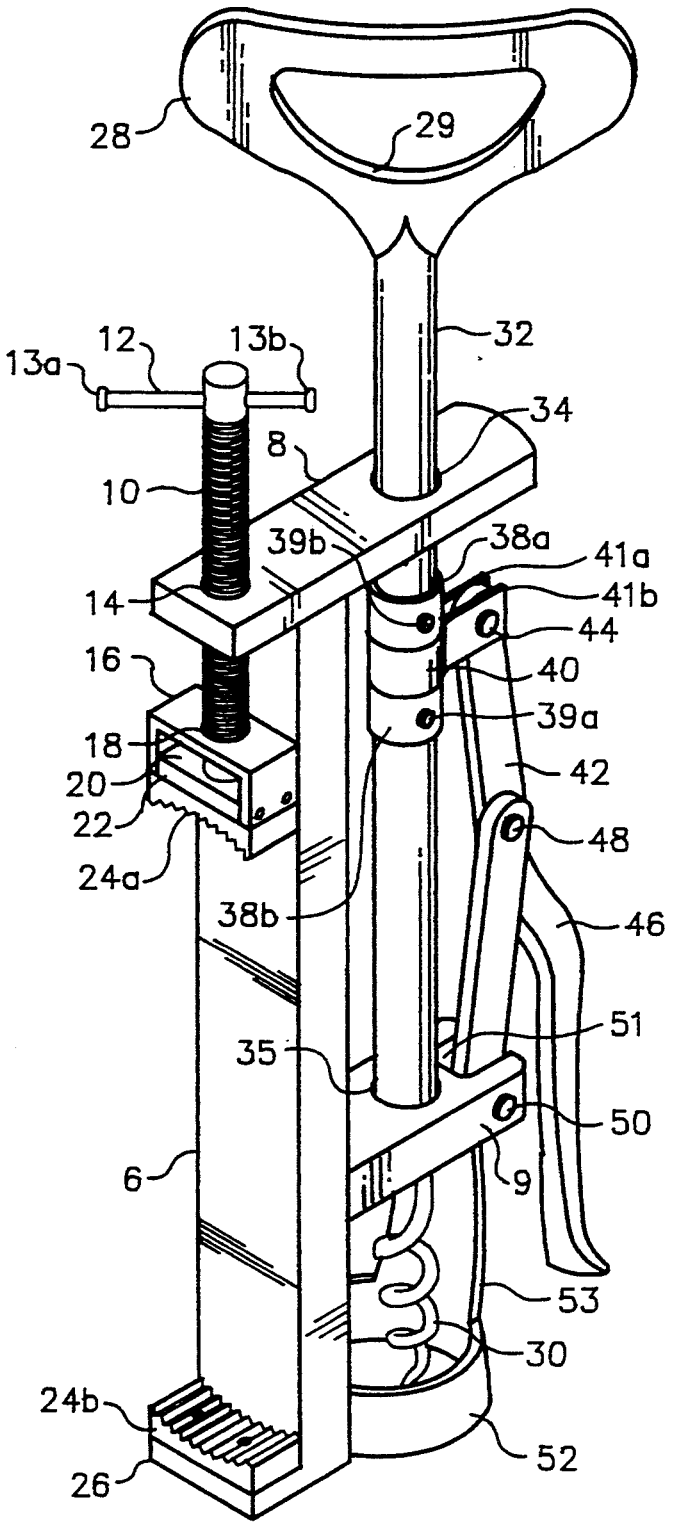
FIG. 1, shows a perspective view of a mechanical bottle and jar opener. Two or more parts of this invention that are identical and have the same working function will have the same number with different alphabetic suffixes.

FIG. 1, shows a perspective view of this invention which the main vertical support post and a pair of cross horizontal bar has a F shape structure. The unit is preferably made by a suitable metal material. Whereas a certain kind of plastic material is also possible to replace some of the parts, however, it is not preferable by the inventor. The drawing shows an upright position to remove a bottle corks. The vertical support post 6 is an elongated, rectangular metal bar. On top of the post 6 is connected with a horizontal upper support bar 8 or a cross T bar. A shorter wing of the cross T bar has a hole which is made into an internal threaded receptacle fastener 14 for a matching external threaded vise screw 10 to screw in. This shorter wing side is for the vise grip system to remove a jar cap. On the other system, a longer wing of T bar has an opening or a shaft hole or slot 34 for a cork screw shaft rod 32 to fit in with a loose fit relationship. At the lower middle section of the post 6, another lower support bar 9 is connected with the post 6 at the right angle. This lower bar has another loose fit shaft hole or slot 35 as a lower shaft rod support. Therefore, the cork screw shaft rod is set through these two slots vertically parallel to the post 6. This elongated, round cork screw shaft rod 32 has a cork screw 30 extended below the lower bar; and has a wing type handle 28 with a bottle cap opener 29 at the upper end above the cross T bar 8. This cork screw shaft unit of 28, 29, 30, and 32 is made as a single connecting part through metal die casting work. The middle part of the shaft 32 at the position just below the cross T bar 8 is installed with a pair of locking rings 38*a* and 38*b*. Both rings are locked with the shaft 32 through a pair of locking pins 39*a* and 39*b*. Between these two rings 38*a* and 38*b*, a lever connector ring 40 is installed. The lever connector ring is installed with a loose fit relationship with the shaft 32. A pair of lever connector ring's arms 41*a* and 41*b* are extended at the right angle as the same direction as the long wing of the upper bar and connected to an elongated lever bar handle 42 through a set of pivot holes and rivet 44. The lever bar handle is dropped down to almost the parallel line along with the cork screw shaft rod. Below the connection 44 at the upper middle part of the lever bar handle 42, a pivot hole is made to connect to the top part of extension bar 46 with a rivet 48. From this connection, the long lever bar is slightly curved out and down where the end of the lever bar is slightly away from the parallel line form the shaft rod. The lower end of the extension bar is connected to a U shape slot 51 at the far end of the lower support bar 9 through another set of pivot holes and rivet 50. The position of the connection of rivet 48 is at the center between the connection of rivet 44 and rivet 50. This center connection of the pivotal point 48 is an elbow connection which has an angle of less than 180 degrees and can be moved to be narrower. Another support base is a bottle neck rim strutter 52 which is a thin, cone like shape connected directly to the footing side of the vertical post 6 and has it's connecting part of an upper support panel 53 connected to the underneath part of the lower bar 9. Whereby the application of this part of the device is to simply place the bottle neck rim strutter 52 on the top of the bottle neck rim and drill the screw into the center of the bottle cork by turning the wing type handle 28. While the screw and shaft is rotating and moving downward upon the drilling, the ring 38*a* is also pushing the lever connector 40 downward. The pressure from the downward movement that connected to the lever will push the center connection 48 or the elbow connection to swing or move outwardly away from the shaft 32 and will make elbow angle to be narrower. This movement will force both extension bar and the lever bar handle gradually change from the vertical position to the horizontal position. The lever arm 42 will be more horizontal when the drilling is completed. To pull a cork out, simply press down the lever arm against the bottle from horizontal position back to the original vertical position.

FIG. 1 further shows the vise system mechanism which functions as an adjustable jar cap opener and is installed on and below the shorter wing of the cross T bar 8. The vise screw 10 is installed on the T bar 8 through the matching internal threaded receptacle fastener 14 of the T bar. The top part of the screw head has a cross hole for rod 12 to slide in as a rod handle. Both ends of this rod handle has a stopper head or lug attached as stopper heads 13*a* and 13*b*. This rod handle 12 can be slid as an adjustable handle. The lower end of the vise screw which is located below the T bar is connected to a U bar 16 of a movable vise grip housing. The screw 10 inserts through the U bar's center hole 18 and is connected to a slotted nut 20 which is larger than the center hole. The lower front opening of U bar 16 is connected and enclosed by a grip support base 22. The support base 22 is affixed with a curve, toothed rubber grip to combine as adjustable grip 24*a*. The footing part of the vertical support post 6 is bent out at a right angle as the grip's support base 26. This support base is affixed with another curved, toothed grip and is a stationary grip 24*b*. The grip 24*b* is facing it's toothed grip directly to the adjustable toothed grip 24*a* at approximately 180 degree angle. Whereby the application of this part of the device is to simply place the center of the top, flat side of a jar cap against the post 6 between the two toothed grips 24*a* and 24*b*. Turn the screw 10 to move the adjustable grip to tighten the jar cap. Using the wing type handle 28 of the unit as a lever handle, turn the device counter clockwise to open the jar. The adjustable grip is movable, therefore, this device can be fit and applied with various sizes of jars.

While a preferred embodiment of the invention herein is shown and describe, it is to be understood that the various changes and improvements may be made therein without departing from the scope and spirit of the appended claim.

I claim:

1. A three-in-one mechanical device for the removing of a bottle corks, bottle caps and various sizes of jar caps, comprising:

(a) a main frame structure of rigid material which consists of an elongated vertical post and a pair of horizontal bars, where an upper cross T bar has a shorter wing to support a grip screw of a vise grip system; and a longer wing to support a cork screw shaft of a cork screw and a lever handle and its connecting parts of a lever system, and said vise system is a mechanical functional device to open various sizes of said jar caps; however said cork screw and lever system is a mechanical functional device to remove said bottle corks, (b) said shorter wing has an opening or hole with an internal threaded receptacle fastener for said grip screw to fit in, and (c) the top end or head section of said grip screw has a cross hole for a rod to fit in as an adjustable rod handle of said screw, said handle has a lug head attached as stopper on each end of said rod, (d) the bottom end of said screw which is located below said upper T bar is connected to a movable vise grip housing which has a curved, rectangular, toothed rubber grip as an adjustable grip installed, (e) another curved, rectangular, toothed rubber grip is attached at the lowest part of said main vertical post as a stationary grip, and (f) the toothed sides of said adjustable grip and stationary grip are set to face each other and they position at approximately 180 degree angle as the straight line along the wide surface of said vertical post, (g) whereby to open a jar simply place the top of said jar cap against said post in-between said curved rubber grips and turn said grip screw to hold said cap very firmly, and then turn the main body of said device counter clockwise to open said jar cap, (h) on the other wing of said T bar, an opening hole is made as an upper shaft slot for said cork screw shaft rod to slide through vertically with a loose fit relationship, and (i) another lower horizontal bar that is connected to the middle lower part of said post at the right angle also has an opening hole as a lower shaft slot for said shaft to slide through vertically, and said upper and lower shaft slots are in line at approximately 180 degree relationship, said shaft rod, therefore, is installed through said upper T bar and said lower bar vertically parallel to said post, (j) a thin metal, cone shape structure connected at the footing of said post as a bottle neck's rim strutter, (k) said cork screw shaft rod has a flat, thin, wing type bottle cap opener connected above said upper T bar as a handle and at the lower end has a connecting cork screw which is extended beyond said lower bar, and said cork screw member is hung in the center of said cone strutter prior to a drilling process, (l) said wing type bottle cap opener handle, screw shaft rod and cork screw is made into a single, connecting unit through a proper metal work process, (m) at the position just below said upper bar, a lever connector ring is installed on said screw shaft rod, and said lever connector ring has it's arms connected to a long lever bar handle through pivot holes and rivet connection means, (n) whereby this wing of the device of said cork screw shaft and it's connecting parts as a drilling unit and said lever bar handle and it's connecting parts as a lever system unit are connected and have a mechanical working relationship for the removal of said bottle cork by a leverage means.

2. The invention of claim 1, wherein said lever system unit for removing said bottle cork, comprising:

(a) said lever system is installed to said shaft through the connection of lever bar handle and said lever connector ring, and (b) said lever connector ring is installed and located in-between a pair of shaft rings which are locked to said shaft rod by a pair of shaft's pins at the position just below said upper bar, said connector ring and shaft rings have the same thickness, (b) said lever connector ring has a pair of short arms which are extended at the right angle and connected to said long lever bar handle through a set of pivot holes and rivet connection means, said long lever handle is normally dropped down to a position almost to the parallel line along with said shaft rod, and (c) at the upper middle part of said lever handle is another set of pivotal and rivet connection between said lever handle and the top part of an extension bar, said pivotal connection is an elbow connection where the angle between the top section of said lever bar handle and said extension bar will be set at less than 180 degrees and can be forced to moved or changed to a narrower angle, (d) the lower end of said extension bar is connected to said lower support bar structure through a set of pivot holes and rivet connection means, and (e) from said center connection, said lever bar handle is bent and curved slightly outward and diverged downward, said lever bar handle extends it's handle downward, approximately level with the lowest part of said main post in a relatively vertical position.

3. The invention of claim 1, wherein said movable vise grip housing which is connected to said screw, comprising:

(a) a thin metal U bar which is the main support of said housing, (b) said U bar has a center hole on it's back for said screw to slide through with a loose fit relationship, and (c) the lower end of said screw is installed with a slotted nut which are larger than said center hole, (d) the front opening of said U bar housing member is enclosed and connected by a rectangular grip support base, (e) said toothed rubber grip member is installed to said support base as said adjustable grip.

* * * * *